United States Patent [19]

Bleke

[11] Patent Number: 4,622,912

[45] Date of Patent: Nov. 18, 1986

[54] DRAFT REDUCTION SYSTEM FOR SHIPS

[76] Inventor: Jim Bleke, 1799 Stumpf Blvd., Suite 2, Bldg. 8, Gretna, La. 70053

[21] Appl. No.: 578,577

[22] Filed: Feb. 9, 1984

[51] Int. Cl.[4] ..... B63B 43/14

[52] U.S. Cl. ..... 114/123; 114/49

[58] Field of Search ..... 114/123, 45, 49 U, 259, 114/260

[56] References Cited

U.S. PATENT DOCUMENTS

| | | | |
|---|---|---|---|
| 435,054 | 8/1890 | Brown | 114/49 |
| 589,133 | 8/1897 | Menzies | 114/123 |
| 3,198,157 | 8/1965 | Livas | 114/49 X |

FOREIGN PATENT DOCUMENTS

| | | | |
|---|---|---|---|
| 141411 | 4/1920 | United Kingdom | 114/49 |

*Primary Examiner*—Sherman D. Basinger
*Attorney, Agent, or Firm*—Keaty & Keaty

[57] ABSTRACT

An apparatus is disclosed for temporarily reducing the effective draft of a loaded cargo vessel in a waterway and assisting the propulsion and steering of the vessel while in a draft reduced condition. The apparatus permits a standard ocean-going cargo vessel to be loaded to a most efficient overall draft depth, and then to be temporarily buoyed to a shallower draft for the purposes of clearing restricted channels, sandbars, ocean entrances and the like. In a prefered embodiment the apparatus is two rigid, self-propelled semi-submersible pontoons having an inner cantilever lifting plate for engaging the lower hull section of the vessel to be supported. The pontoons are interconnected by a support cable system under controllable tension. The pontoons in operation are submerged to an operating depth and moved, using internal propulsion equipment, so as to pass underneath and straddle the hull of the desired cargo vessel. The pontoons are then drawn together, reduced in ballast, and raised to a floating condition, whereupon they rise simultaneously on both sides of the ship hull, engaging the ship hull with a provided cantilever pontoon edge. The cable structure does not bear the weight of the ship hull but retains the pontoons in a joined condition against the hull of the ship. The buoyant effect of the pontoons reduces the draft of the cargo vessel to a desired shallower draft for clearing known maritime obstacles. The entire vessel is then propelled by the combination of the onboard pontoon propulsion machinery and the vessel's own propulsion and steering machinery to a location where the vessel can be lowered to its natural draft. The pontoons are then submerged, releasing the vessel, the pontoons then are propelled back a next point of use. The structure disclosed permits ships to be loaded to an optimum draft for most efficient cargo handling and permits the ships to be handled in channels or rivers of shallower draft without requiring constant dredging or other environmentally damaging activities.

12 Claims, 9 Drawing Figures

DRAFT REDUCTION SYSTEM FOR SHIPS

BACKGROUND OF THE INVENTION

In maritime commerce ocean-going cargo vessels are found to have an optimum draft for most efficient carriage of cargo. The more a cargo vessel can be loaded up to its optimum draft, the more efficient its usage. As more cargo is carried, unit costs are lowered and the more effective overall maritime commerce becomes. This is basically because over a wide range of ship loadings, the costs of operating a cargo vessel is essentially a function of the calendar days it is in operation and the number of sea miles that it travels.

The use of ocean-going ships to transport cargoes to maritime ports via shallow channels, canals, or rivers or in enclosed harbors, presents a restriction on the overall operational capabilities of an ocean-going cargo vessel. It is commonly found that many cargo vessels are capable of being utilized at drafts well in excess of the maximum depth within the exisiting maritime channels on inland waters in the United States. This has lead to extensive, expensive long term engineering projects which attempt by dredging or by other means to artificially maintain river channels at depths suitable for full ocean-going vessels. Such dredging is expensive and requires constant work. In addition, it introduces significant environmental hazards into coastal marshlands and wetlands areas, especially by permitting salt water intrusion further up into fresh water estuaries than otherwise would naturally occur. This salt water intrusion has been known to cause serious damage to coastal waters' ecology, especially in regards to the disturbance of the habitat for many valuable maritime species in commerce such as shrimp and oysters.

Methods of temporarily reducing the draft of vessels have been suggested, primarily within the area of maritime salvage. They generally take the form of buoyant bags or bladders, interconnected by cables and nets, which are placed under the hull of a vessel and which are used to lift it clear of the water. The resulting conglomeration essentially is unpropellable due to extensive drag and the lack of any steerage way or control.

Alternative forms of buoyancy reduction have been developed within the area of drydocks, in which large, relatively complicated structures are used to raise ships totally clear of the water level. Such structures have severe strength restrictions because they are also designed to support ship repair activities, and thus they are generally only capable of raising a ship which has been emptied to its lowest displacement weight. In addition they are static structures; they are not intended to propell or to otherwise permit the motion of a ship while it is raised to the more buoyant position.

SUMMARY OF THE INVENTION

The invention disclosed herein is a coordinated dual pontoon apparatus which is self-propelled and which is capable of raising and transporting an ocean-going cargo vessel through a channel of reduced draft.

In essence, the invention comprises two pontoon hulls, each being a rigid self-propelled semi-submersible vessel interconnected by a cable structure which is designed primarily to hold a constant hull-to-hull distance between the two pontoons. The two-pontoon-and-cable structure defines an inner support area and an inner side to each pontoon. Along this inner side a specific cantilever support beam plate is constructed, designed to engage and lock under the standard hull shape of an ocean-going vessel.

In operation, the pontoons are submerged and moved to straddle beneath a given ocean-going vessel at deep draft. The pontoons are then blown or raised to a more buoyant status. In rising, the provided inner support plate structure on the inner side of each pontoon engages the hull of the ocean-going vessel, raising it in a safe and coordinated manner to a shallower draft. The cable structure serves to lock the pontoons together against the hull of the ship. The overall apparatus is designed to achieve approximately a 10 to 15 foot draft reduction on a standard deep sea ocean-going vessel. This amount has been found sufficient to clear most known maritime obstacles and restrictions in most ocean-going inland waters in the United States.

The rigidity of the pontoon hulls, coupled with the provided internal propulsion machinery, is used in conjunction with the existing propulsion and steerage machinery aboard the ocean-going vessel to provide, as a combination, a controlled, steerable, shallower draft vessel which may then be moved under its own power through a waterway of resticted draft and scope. The essentially elongate narrow pontoons provide relatively little width increase to the overall ocean-going vessel, whereas the shallower draft provided by the overall combination permits the clearance and navigation in shallower waters than otherwise would be suitable for the vessel concerned.

The combination may be navigated using standard piloting practices until it is in deep ocean, well clear of maritime depth restrictions. The pontoons may then be readily separated from the vessel by submersion and then will return, under their own power, to the point of origin. Alternately, they may be used to engage and raise a waiting vessel in the deep ocean, permitting it to traverse shallower inland waterways to desired point of offloading on the inland waters.

It is an object of this invention to provide a simplified, self-propelled structure capable of reducing the draft of an ocean-going vessel while preserving its navigational and seaworthyness characteristics.

It is a further object of this invention to provide an apparatus permitting the use of deep draft ocean-going vessels in channels without requiring the extensive use of dredging or other waterway modification techniques.

It is a further object of this invention to permit ocean-going vessels to be loaded to a more efficient displacement while in commerce on inland waters of restricted depths.

This and other objects of the invention will become more apparent from the detailed description of the preferred embodiment which follows.

Figure 5:
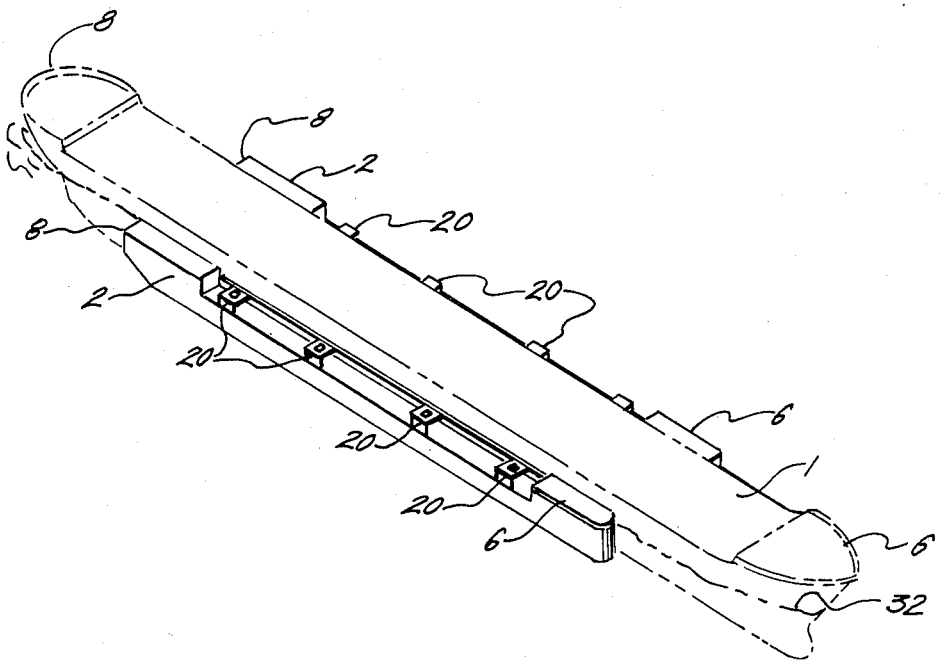
FIG. 5 is a angled elevation view of the pontoon hulls as coupled to a ship.
Figure 6:
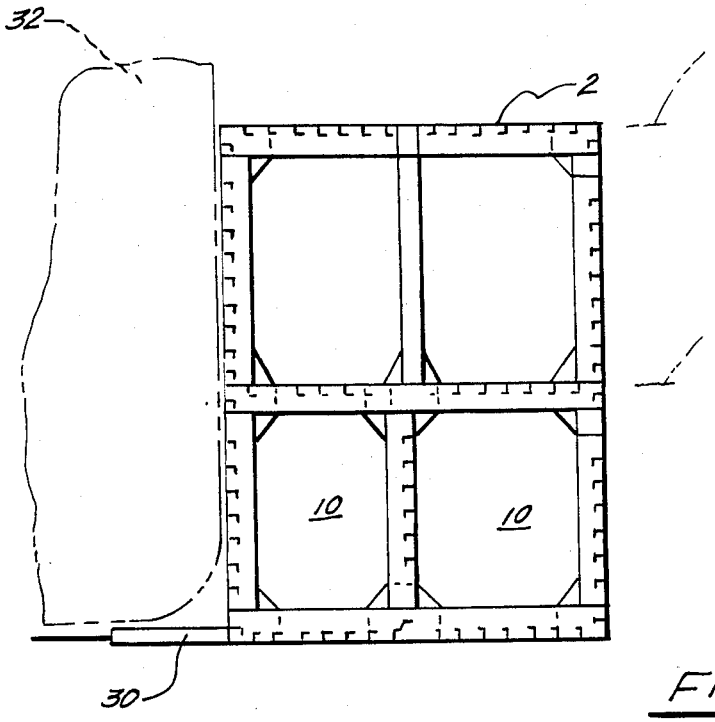
FIG. 6 is a transverse section view of a detail of the pontoon hull as coupled to a ship.

DETAILED DESCRIPTION OF THE PREFERRED EMBODIMENT:

Referring to FIG. 5, the invention is shown, in conjunction with a ship 1 as comprising two elongate pontoon hulls 2, which will be described below and which essentially comprise individual semi-submersible vessels, having self-propulsion capability, and having a direct interconnection so that they may be mechanically operated jointly.

Figure 1:
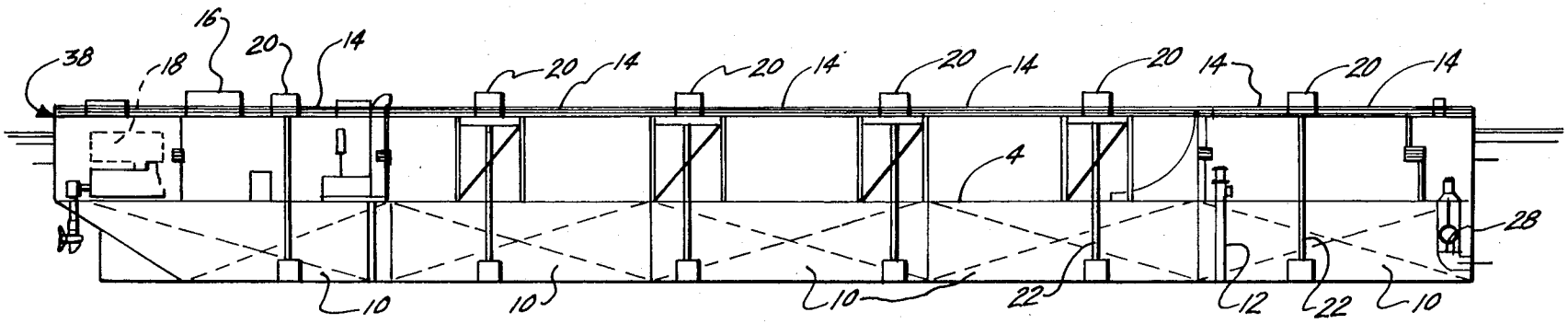
FIG. 1 is a side sectional view of the starboard pontoon hull.
Figure 2:
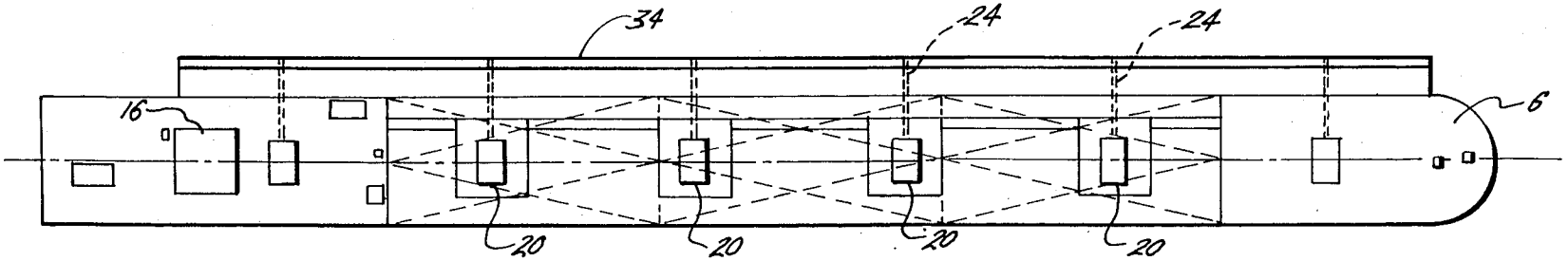
FIG. 2 is a top set view of the starboard pontoon hull.
Figure 3:
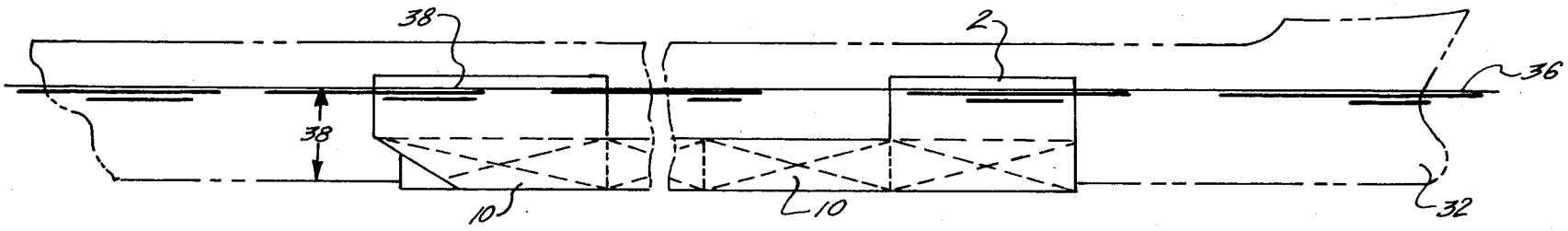
FIG. 3 is a side view of the pontoon hull coupled to a ship at maximum ship draft.
Figure 4:
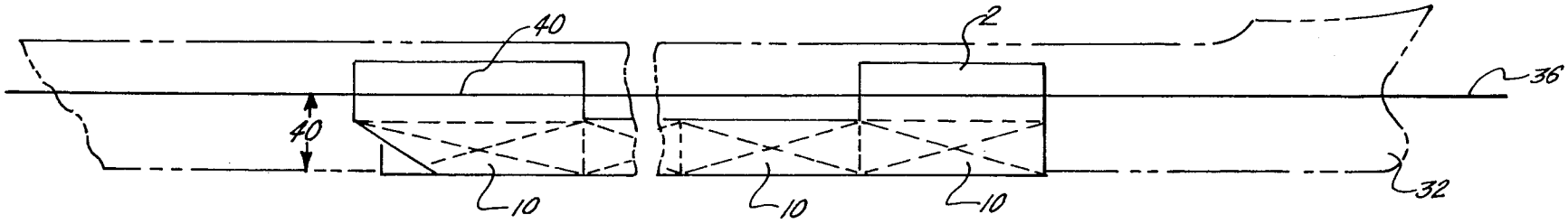
FIG. 4 is a side view of the pontoon connected to a ship at the reduced ship draft.

In detail, FIGS. 1 and 2 show the starboard hull 2, it being apparent from FIG. 5 that the hulls 2 comprise a port and a starboard hull with respect to the overall ship 1. Starboard hull 2 is typical; the port hull 2 is identical fore and aft, differing only in that it is a mirror image of the starboard hull 2 with respect to a central axis running fore and aft the length of the hull.

Hull 2 is seen to comprise a mid-deck segment dividing hull 2 vertically into two sections. Hull 2 has a bow portion 6 and a stern 8. Mid-deck 4 defines a lower ballast tank hull 10 which is comprised primarily of an elongate series of pumpable ballast tanks which are filled with a mixture of water or air so as to establish an overall draft or buoyancy of the pontoon hull 2. Ballast within the ballast tanks 10 is taken on or reduced by, in the preferred embodiment, a main ballast pump means 12.

Rising above the mid-deck 4 in both, the bow and the stern portions of the pontoon hull 2 are main deck sections 14. The main deck sections 14 comprise the main above water working spaces within each of the pontoon hulls 2 and at the upper extremity of the main decks 14 define an upper working level for the hull 2 which is always in an above water plane condition throughout the submersible range of the ballast tanks 10.

The principal machinery found upon the main decks 14 are the main control spaces 16 located aft; main fuel tanks and bunker spacers 18 also located aft. Running from fore to aft, periodically spaced, are found the principal winch means 20. Winch means 20 each individually run a length of wire rope or wire cable downward through the hull's pipes 22 and out the inboard side of the hull 2; the inboard side of the hull 2 is defined with respect to the side that is closest to the ship 1 when the pontoon hull 2 is in the position of operation. The direction of the cable 24 through the hull's pipes 22 is converted from a vertical direction downward from the winches 20 to a horizontal direction outward by means of a sheave arrangement (not shown) at the lower end of the hull's pipes 22. In a preferred embodiment to the invention, wherein the overall pontoon hull 2 is of an approximate length of 420 feet, an approximate beam of 40 feet, an approximate depth of 54 feet, and a napproximate overall working draft of 50 feet, displacing thereby fifteen thousand long tons, there are six such winches 20. For each winch 20 and each hull's pipe 22 thereto appending, the wire cable 24 is continuously reaved from a given winch 20 on the starboard pontoon hull through the hull's pipe 22 of said hull, thence across and through the corresponding hull's pipe 22 on the port hull, thence contiuously through the hull's pipe 22 to the corresponding winch 20 thus, in the preferred embodiment, six continuous wire cables 24 interconnect the port and the starboard pontoon holes 2, said interconnection being through and by means of the corresponding set of winches 20 upon the port and starboard pontoon hulls 2.

At the stern 8 of the pontoon hull 2 may be found the main propulsion machinery 26. In the preferred embodiment of the invention the main propulsion machinery is an above water line engine of standard marine design, a diesel engine, operating a steerable propeller through a 90° angle drive of a design well understood in the art. Forward propulsion 28 is located at the bow portion 6 of the pontoon hull. In the preferred embodiment of the invention forward propulsion means 28 comprises water jet thruster means of approximately 350 horsepower size adapted to producing a sideways moment either to starboard or to port at the bow 6 of the pontoon 2.

At the location of a plane through the bottom of the pontoon hull 2, extending substantially the length of the pontoon hull 2, may be found a cantilever hull support ledge 30 which extends a distance outboard along the port side of the starboard pontoon hull 2. The corresponding cantilever hull support ledge 34 the port pontoon hull 2 extends to the starboard thereof. Jointly therefor, the cantilever hull support ledges 30 extend inboard of the adjoined pontoon hulls 2. It has been found desirable that the cantilever support ledges 30 and the corresponding inboard sides of the pontoon hull 2 be provided with fenders or shoring. In the preferred embodiment of the invention, for the vessel size aforementioned the cantilever hull support 30 extends outboard of the pontoon hull approximately 10 feet and there is provided the length of its outer upper edge a continuous eight inch oak block, having a width of approximately thirty-six inches. A similar block is provided the length of the inboard side of the pontoon hull 2 at an elevation adjacent to the main decks 14. Together these fenders absorb, sacrifically, the majority of the wear and impact inherent in the adjoining of the pontoon hulls 2 to the ship 1 as hereinafter described.

Figure 7:
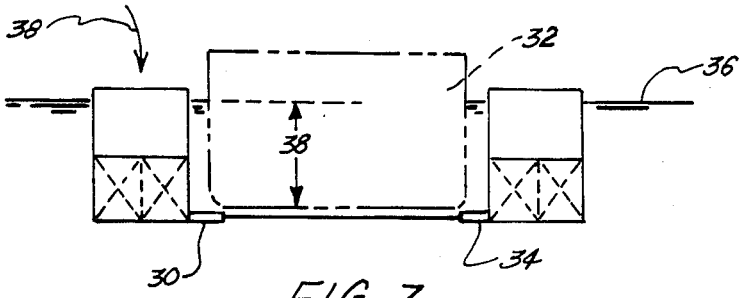
FIG. 7 is a transverse section view of the pontoons engaging a ship at full draft.
Figure 8:
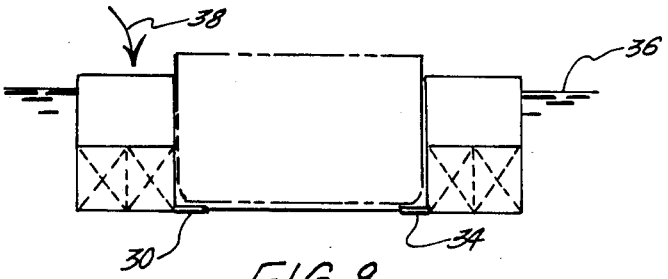
FIG. 8 is a transverse section view of the pontoons, secured to a ship.
Figure 9:
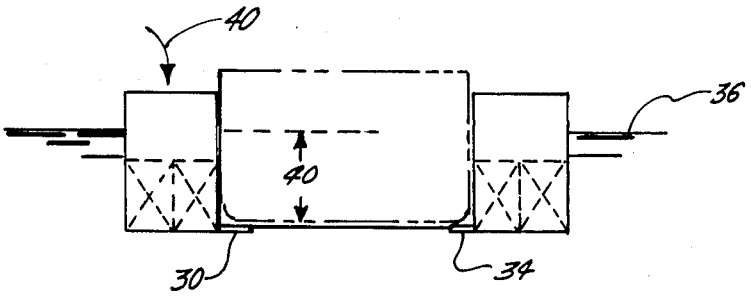
FIG. 9 is a transverse section view of the pontoons, coupled to ship, at reduced draft.

Turning to FIGS. 7, 8, and 9, in operation the invention is seen as it is run forward to ship hull 32. FIG. 5 shows in elevated form the appearance of the overall pontoon hulls 2 with respect to the ship 1. Under the particular preferred embodiment herein described, as will be recalled, the overall length of the preferred embodiment described is 420 feet. It is to be noted that this occupies approximately the middle third of the overall length of the ship with which it is to be used. The preferred embodiment discussed is designed to be used with a ship 1 of an approximate draft fully loaded of 45 feet. The draft is shown as full draft 38 with respect to water level 36 and keel of the ship 1. The pontoon hulls 2 are flooded by essentially filling the ballast tanks with water to a depth of 50 feet of working draft, leaving approximately three feet of freeboard. In this position, the wire cables 24, easily clear by approximately 5 feet, the ship keel of the ship 1 and by means of the propulsion systems of the pontoon hulls 2, they are readily maneuvered to a position a mid ships the ship 1. The winches 20 are then activated drawing in in a coordinated manner the wire cable 24 so as to put an even tension upon each of the wire cables 24 so as to evenly draw the pontoon hulls 2 together about the ship hull 32 of the ship 1. It is to be noted that the cantilevered hull support 30 is beneath the lower keel of the ship 1. It is also to be noted that the particular curvature of the ship keel is typical of the mid-ship's third of a standard oceangoing freighter having an essentially flat keel. When the winches 20 have drawn the cable 24 to a tension such that there is a slight rotary moment tending to rotate the pontoon hulls 2 to a list condition due to the tension upon the cables 24, winching is ceased and the ballast is evenly pumped using the ballast pumping means 12 from each of the pontoon hulls 2 so as to raise the pontoon hulls 2 to a working draft. In the preferred embodiment herein described, approximately a ten foot rise can be obtained in the overall combined ship 1 and pontoon hulls 2 combination reducing the overall assemblage to approximately 35 feet. This reduced draft 40 is in general found sufficient to clear most river or maritime obstacles in channels of commerce declared open to oceangoing traffic. It would be found in fact that without the use of the instant invention, the ship 1 would normally only be loaded to a 35 foot working reduced draft 40 and thus would lose the effective cargo carrying capacity of the additional 10 feet of draft. It will be readily apparent to those skilled in the art that this ten foot draft reduction represents a significant portion of the overall useable cargo capacity of the ship 1. Taken over all the ships involved in maritime commerce from a given location, a loss of carrying capacity of this nature is such as to provide significant economic impetus towards such activities as deeper dredging of channels or major projects for opening alternate waterways at great expense. As an example, there are currently active proposals to dredge the Mississippi River from Baton Rouge, Louisiana to the Gulf of Mexico approximately ten feet deeper, even though such dredging will require continuous maintenance and redredging and will significantly effect salt water intrusion into the lower river estuary of the Mississippi Delta.

It can be readily seen that when joined to the reduced draft 40 configuration, the combination of the ship 1 and the pontoon hulls 2 provide a unitized navigable vessel capable of propulsion, steerage and control having a reduced draft and yet, as a cargo carrying instrument, representing a fully loaded ship 1, loaded to its optimum full draft 38. The combined assemblage thus is navigated to a point at which navigation at full draft 38 may be readily had, the process reversed by flooding the ballast tanks 10 so as to submerge the pontoon hulls 2 to their full working draft 38 permitting the cables 24 and hull support ledge 30 to clear the ship keel of the ship 1, thereby releasing ship 1 for further passage. The pontoon hulls 2 of the invention, being self-propelled may then be moved as a vessel to the next point of use.

It is the essence of this invention that the ship 1 throughout is supported by the cantilever hull support ledges 30, 34 rather than resting in an uncontrolled manner upon wire ropes, cables, nets or the like. It is also the essence of this invention that the overall pontoon hulls 2 are individually and coordinately self-propelled units of semi-submersible design having both the capability of independent navigation and the capability of independently achieving one of two buoyancies.

It can be seen that the purpose of the cables is merely to secure the pontoon hulls 2 in an optimum position for lifting the ship 1, and that the ship 1 is mechanically lifted by the buoyancy of the pontoon hulls 2 as communicated to the ship hull 32 through the ship keel by the cantilever hull supports 30, 34 of the instant invention.

It can thus be seen that the specific invention is susceptible to a number of variants, especially in regards to the exact design of the tensioning cables 24, the number of tensioning cables 24, the specific propulsion and ballasting means of the pontoon hulls and the exact design of the cantilever support ledges 30, 34 so as to adapt it to a number of different ship hulls 32.

It can thus be seen that the invention is susceptible to wider equivalents than the specific example given here as the preferred embodiment. What is invention is as claimed in the claims which follow.

I claim:

1. An apparatus for reducing the draft, in navigation, of a vessel, comprising:

a. a first and a second semi-submersible hull means;

b. tension means, cooperatively joining said first and said second hull means, adapted for drawing said first and said second hull means into adjoining relationship to starboard and port of the vessel;

c. means for supporting said vessel under at least part of its bottom at a location inboard of the sides of said vessel during the draft reduction operation, said means rigidly extending outwardly from said semi-submersible hull means and at the bottom thereof;

d. ballast means for varying the buoyancy of said first and said second hull means; and e. controllable propulsion means within said first and said second hull means.

2. An apparatus as described in claim 1 above wherein each of said first and said second hull means further comprises:

a. an elongate semi-submersible hull;

b. at least one ballast tank means within said hull;

c. at least one ballast pumping means adapted to pumping liquid ballast reciprocally between said ballast tank means and an outside of said hull.

3. An apparatus as described in claim 1 above wherein said tensioning means further comprises:

a. a plurality of winch means, each of which further comprises:

i. a first cable winch means, adapted to tensioning a wire cable, mounted upon said first hull;

ii. cable passage and sheave means adapted to passing said cable from said first winch to an external point adjacent a bottom section of said first hull;

iii. second hull's passage and sheave means for receiving said cable at a point external to beneath said second hull, passing said cable to;

iv. second which means, mounted on said second hull, adapted for cooperatively tensioning said wire cable against said first winch means.

4. An apparatus as described in claim 1 above, wherein said vessel support means further comprises:

a cantilevered support beam extending outwardly from a point adjacent the bottom of said semi-submersible hull, for a distance along the longitudinal axis of said semi-submersible hull, adapted to extending under said oceangoing vessel when said tensioning means are activated to adjoin said first and said second semi-submersible hulls to said vessel.

5. An apparatus as described in claim 4 above, wherein said support means further comprise:

fender means interposed between said semi-submersible hull, said support means, and said oceangoing vessel.

6. A method of temporarily reducing the draft of an oceangoing vessel, comprising:

a. providing a first and a second semi-submersible, self-propelled elongate vessels;

b. maneuvering said first and said second vessels so as to position an oceangoing vessel of a certain draft between the semi-submersible vessels;

c. providing a tensioning means, joining a plurality of points adjacent a lower edge of said first semi-submersible vessel to a plurality of points adjacent a lower edge of said second semi-submersible vessel;

d. tensioning said tensioning means so as to draw said first and said second semi-submersible vessels tightly against said oceangoing vessel, defining thereby an inboard side adjacent to said oceangoing vessel for said first and said second semi-submersible vessels;

e. providing rigid hull engaging means at the lower edge of said first and said second semi-submersible vessels extending inboard of said first and said second semi-submersible vessels for supporting said oceangoing vessel under the bottom and inboard the sides of said oceangoing vessel;

f. deballasting said first and said second semi-submersible vessels so as to increase the buoyancy thereof; and g. raising said oceangoing vessel to a reduced draft.

7. The method as described in claim 6 above wherein the method further comprises the steps of:

a. forming thereby a unitized assemblage of said first and said second semi-submersible vessels together with said oceangoing vessels; and b. navigating said assemblage from a first point on a navigable waterway to a second point on a navigable waterway.

8. An apparatus for reducing the draft of a ship, comprising:

a pair of buoyant self-propelled vessels, having inboard and outboard sides, adapted to stabilize the position of the ship during the draft reduction process;

means for selectively drawing said vessels closer to each other into a position adjoining the sides of the ship along the inboard sides of the vessels;

rigid means extending from said inboard sides at the bottom of said vessels for substantially supporting the ship at least under a part of its bottom portion located inboard of its sides;

ballast means mounted on the buoyant vessels, adapted to provide for buoyancy change of the vessels.

9. The apparatus of claim 8, wherein each of said vessels comprises:

an elongated hull;

a cantilever beam securedly attached along the inboard side of the vessel hull at the bottom portion of the hull and extending a distance from the hull to substantially support the ship during the draft reduction operation;

at least one ballast tank means, adapted to contain a variable amount of ballast;

at least one pump means selectively varying the amount of ballast contained in the ballast tank means.

10. The apparatus of claim 8, wherein said means for selectively drawing the vessels closer to each other comprise at least one winch mounted on one vessel in opposed relationship to at least one winch mounted on the second vessel to allow for a cable contained in said winches to be selectively wound upon reels of said winch.

11. The apparatus of claim 10, wherein said vessels are further provided with means to allow the cable to be pulled under the bottom of the ship.

12. The apparatus of claim 10, further comprising propulsion means mounted on each vessel to allow the vessels to be propelled synchronously in side-by-side relationship alongside the ship.

* * * * *